US005449871A

United States Patent [19]

Batteux et al.

[11] Patent Number: 5,449,871

[45] Date of Patent: Sep. 12, 1995

[54] OPERATING MECHANISM OF A MULTIPOLE ELECTRICAL CIRCUIT BREAKER

[75] Inventors: Pierre Batteux, St. Pierre de Mesage; Jean-Luc Payet-Burin, Voreppe, both of France

[73] Assignee: Merlin Gerin, France

[21] Appl. No.: 220,017

[22] Filed: Mar. 30, 1994

[30] Foreign Application Priority Data

Apr. 20, 1993 [FR] France ..... 93 04858

[51] Int. Cl.[6] ..... H01H 9/24

[52] U.S. Cl. ..... 200/401; 200/DIG. 42

[58] Field of Search ..... 200/401, 325, DIG. 42

[56] References Cited

U.S. PATENT DOCUMENTS

| | | | |
|---|---|---|---|
| 3,605,052 | 9/1971 | Dimond et al. . | |
| 4,368,444 | 1/1983 | Preuss et al. | 200/401 X |
| 4,546,224 | 10/1985 | Mostosi | 200/401 |
| 5,142,112 | 8/1992 | Parks et al. | 200/401 |
| 5,290,928 | 3/1994 | Beck et al. | 200/401 |

FOREIGN PATENT DOCUMENTS

| | | |
|---|---|---|
| 0450904 | 10/1991 | European Pat. Off. . |
| 0516448 | 12/1992 | European Pat. Off. . |
| 2262859 | 9/1975 | France . |
| 1288716 | 9/1972 | United Kingdom . |

*Primary Examiner*—Renee S. Luebke

*Attorney, Agent, or Firm*—Parkhurst, Wendel & Rossi

[57] ABSTRACT

An operating mechanism of a multipole circuit breaker comprises a toggle associated with an automatic tripping hook and an operating handle cooperating with a pivoting locking lever arranged to block the handle in an intermediate position in case of welding of the contacts. When normal opening of the contacts takes place, the locking lever comprises a radiating bearing surface cooperating with a protuberance of the bar to keep holding the locking lever in the first active position of the stop, during a first part of the opening travel of the movable contact of each pole, and a notch for receiving said protuberance causing unblocking of the locking lever to release the base close to the end of opening travel of the movable contact.

7 Claims, 5 Drawing Sheets

OPERATING MECHANISM OF A MULTIPOLE ELECTRICAL CIRCUIT BREAKER

BACKGROUND OF THE INVENTION

The invention relates to an operating mechanism of a multipole electrical circuit breaker, comprising:

a pair of parallel support plates between which the mechanism is housed, a toggle formed by a pair of first and second rods articulated together by means of a first pivoting spindle, a switching bar mechanically coupled to the first rod, and acting as support for the movable contacts of all the poles, said bar being mounted in rotation around a second parallel spindle, to ensure closing and opening of the contacts, a tripping hook pivotally mounted between a charged position and a tripped position around a third spindle of the support plates, and articulated simultaneously on the second rod, an operating handle securedly united to a base articulated on a fourth fixed spindle of the support plates, a latch cooperating with an end of the tripping hook to form a mechanical latching in the charged position, a connecting spring anchored between the first spindle and the base of the handle, and a locking lever cooperating with the bar to block the base in an intermediate position S of the handle when the contacts are welded, said locking lever being pivotally mounted on a fifth spindle of the support plates, and comprising a stop able to occupy a first active position or a second inactive position according to the angular position of the bar.

The U.S. Pat. No. 3,605,052 describes a circuit breaker of the kind mentioned in which the position of the operating handle gives a reliable visual indication of the position of the components constituting the circuit breaker. The operator can thus detect a malfunctioning, notably welding of the contacts, and any resetting or movement of the handle to the open position is then rendered impossible by the presence of the locking lever which blocks the handle in the intermediate position. The locking lever is pivotally mounted on a spindle of the support plates, and is controlled by a feeler according to the angular position of the bar. This feeler is formed by a simple tab resting on the upper face of the bar. The handle returns automatically to the closed position by the action of the connecting spring of the mechanism.

The U.S. Pat. No. 2,262,859 provides in addition an initial pretripping commanded at the beginning of the movement travel of the handle, followed by blocking of the handle by the locking device.

The U.S. Pat. No. 5,142,112 describes a fork-shaped locking lever cooperating with the switching bar. The whole surface of the fork surrounds the bar when the latter is in the closed position of the contacts. In case of normal opening of the contacts, the bar drives the locking lever to the unblocking position right at the beginning of the opening travel. This results in anticipated unblocking of the locking lever, before formation of the disconnection distance required between the separated contacts.

SUMMARY OF THE INVENTION

The object of the invention is to achieve an operating mechanism for a circuit breaker with positive safety, preventing any movement of the handle to the open position if the disconnection distance between the contacts is not reached.

The mechanism according to the invention is characterized in that the locking lever comprises a radiating bearing surface cooperating with a protuberance of the bar to keep holding the locking lever in the first active position of the stop, during a first part of the opening travel of the movable contact of each pole, and a notch for receiving said protuberance causing unblocking of the locking lever to release the base near the end of the opening travel of the movable contact.

Temporary blocking of the stop is maintained during the sliding movement of the end of the protuberance along the radiating bearing surface of the locking lever until the disconnection distance between the contacts is reached. Release of the base then takes place after the locking lever has been unblocked near the end of the opening travel.

The bearing surface of the locking lever can be shaped as an arc of a circle, centered on the spindle of the bar, or a flat portion extending appreciably according to a direction tangent to the protuberance when rotation of the bar takes place during the first part of the opening travel.

The base is provided with a blocking lug designed to come into engagement in said intermediate position S of the handle against the stop being in the first active position.

BRIEF DESCRIPTION OF THE DRAWINGS

Other advantages and features will become more clearly apparent from the following description of an illustrative embodiment of the invention, given as a non-restrictive example only and represented in the accompanying drawings, in which.

DETAILED DESCRIPTION OF THE PREFERRED EMBODIMENT

Figure 1A:
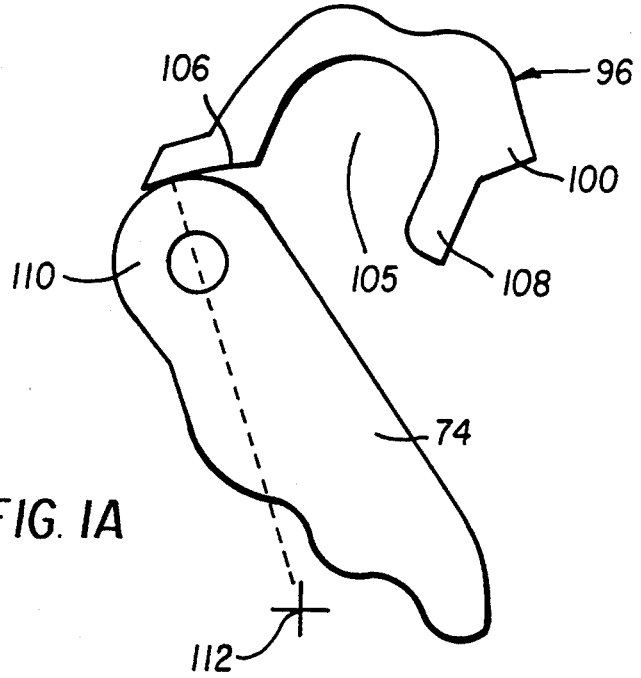
FIG. 1A shows a detailed view on an enlarged scale of a part of the mechanism of FIG. 1.

In the figures, a multipole circuit breaker 10 with molded insulating case 12 comprises a breaking module 14 per pole, formed by a monoblock cartridge 16 made of molded plastic material, and having the shape of a parallelepiped rectangle. The cartridge 16 comprises a base plate 18, a front panel 20 having an orifice 22 for passage of a movable contact 24, two parallel large side panels 26, 28 and two parallel small side panels 30, 32 for connection.

Inside the cartridge 16 there are located two stationary contacts 34, 36 respectively connected by connecting conductors 35, 37 to a first contact strip 38 of a connection terminal 40, called circuit breaker pole input terminal, and to a second contact strip 42 designed to be connected by a screw 43 to a third contact strip 44 of a trip device.

The trip device comprises a magnetothermal trip module 46, equipped opposite from the contact strip 44 with a fourth contact strip 48 forming part of the other connection terminal 50 of the circuit breaker pole, called output terminal. The trip module 46 is connected in series in the pole with the contacts 34, 36, 24 of the breaking module 14. The trip module 46 comprises in addition a bimetal strip 54 and a mobile blade 56.

In the closed state of the circuit breaker, the current enters via the input terminal 40, and flows successively in the first contact strip 38, conductor 35, stationary contact 34, movable contact 24, other stationary contact 36, conductor 37, contact strips 42, 44, trip device 46, contact strip 48 and output terminal 50.

The trip device comprises in addition a trip bar 52 mounted with limited rotation between a charged position and a tripped position according to the position of the component actuating the trip device 46, which component is either the bimetal strip 54 or the blade 56. The rotary bar 52 is moved to the tripped position as soon as the current flowing in the pole exceeds a preset threshold. The trip bar 52 moreover cooperates with a latch 58 of an operating mechanism 60 with toggle 62 and handle 64.

Figure 2:
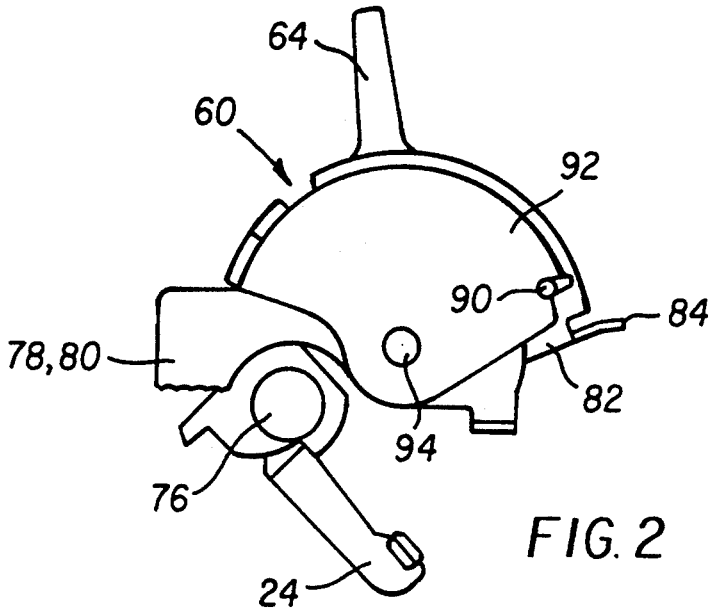
FIG. 2 shows an elevational view of assembly of the operating mechanism to the switching bar.
Figure 3:
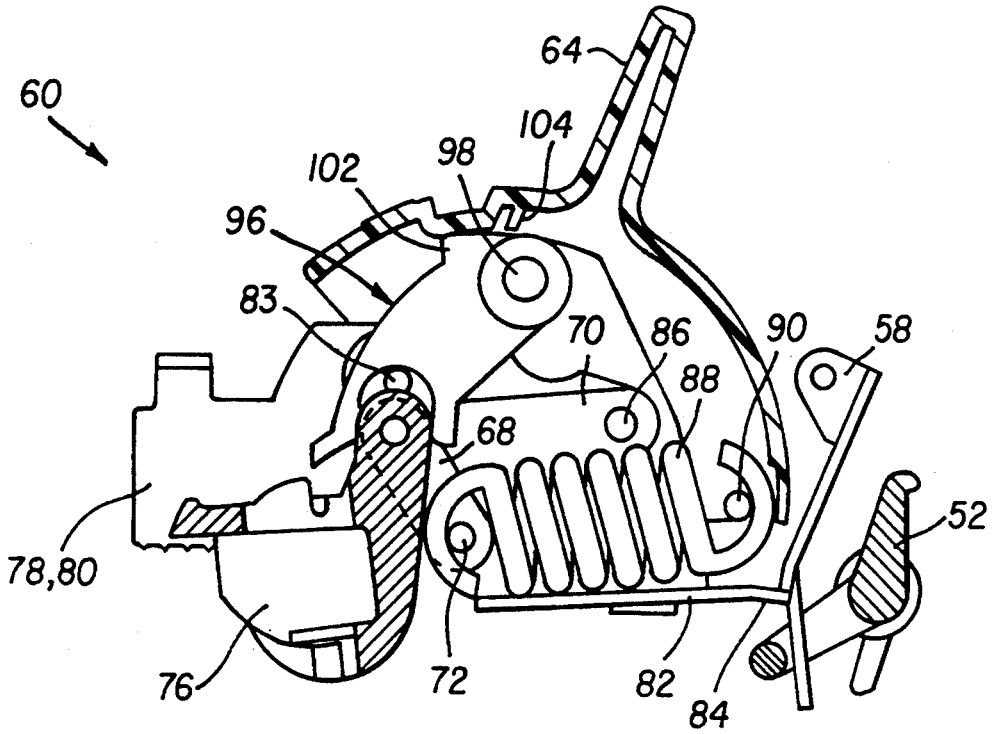
FIG. 3 represents a sectional view of the mechanism of FIG. 1.

The mechanism 60, represented in detail in FIGS. 2 and 3, is common to all the poles, only the handle 64 being accessible from outside passing through an aperture 66 of the case 12, for manual operation of the circuit breaker 10.

The toggle 62 of the mechanism 60 comprises a lower rod 68 articulated on an upper rod 70 by a pivoting spindle 72. The lower rod 68 of the toggle 62 is coupled to a protuberance 74 of a switching bar 76 acting as support for the movable contacts 24 of all the poles. The switching bar 76 is made of insulating material and extends parallel to the trip bar 52 in the transverse direction of the poles.

The mechanism 60 is housed between two parallel metal support plates 78, 80, and comprises a tripping hook 82 pivotally mounted on a spindle 83 of the support plates 78, 80. The free end 84 of the hook 82 is engaged in the charged position with the latch 58 to form a catch. The upper rod 70 of the toggle 62 is articulated on a spindle 86 of the tripping hook 82, and a connecting spring 88 is secured between the pivoting spindle 72 of the toggle 62 and a spindle 90 securedly united to the base 92 of the handle 64. The base 92 is shaped as a flange articulated on a spindle 94 of the support plates 78, 80 to ensure movement of the handle 64 between the two positions, closed F and open O.

An unlocking action of the trip bar 52 on the latch 58 releases the catch, and the mechanism 60 is discharged due to the expansion action of a connecting spring 88, resulting in movement by pivoting of the toggle 62 and rotation of the bar 76 to the open position of the contacts 34, 36, 24 of all the poles. The order to unlock the latch 58 can come from the magnetothermal trip module 46, or from an auxiliary trip device, notably an undervoltage release MN, shunt release MX, differential trip device, etc.

Figure 4:
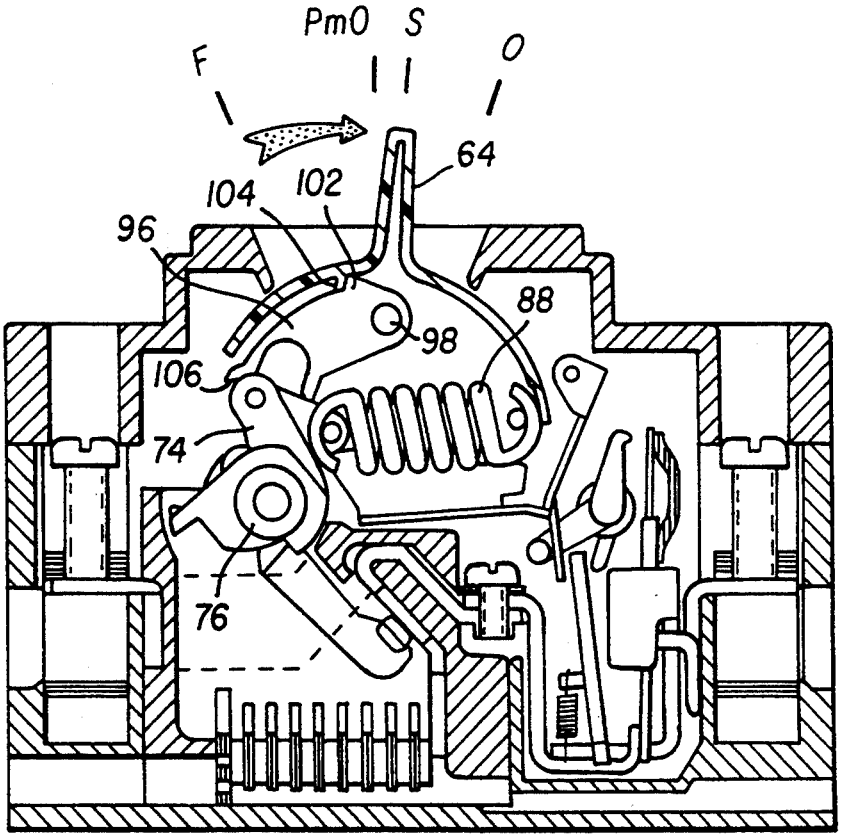
Figure 5A:
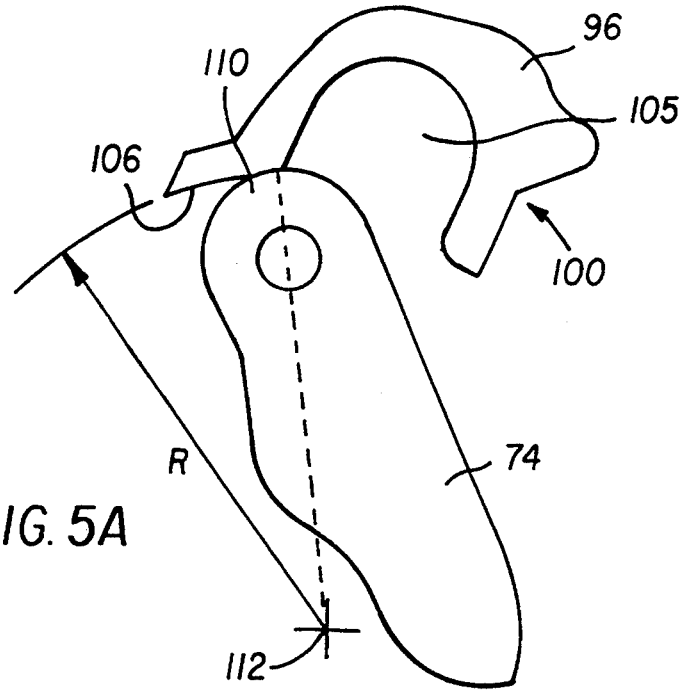
FIGS. 5 and 5A are identical views to FIGS. 1 and 1A, at the beginning of opening travel of the contacts corresponding to the isolation distance.
Figure 5:
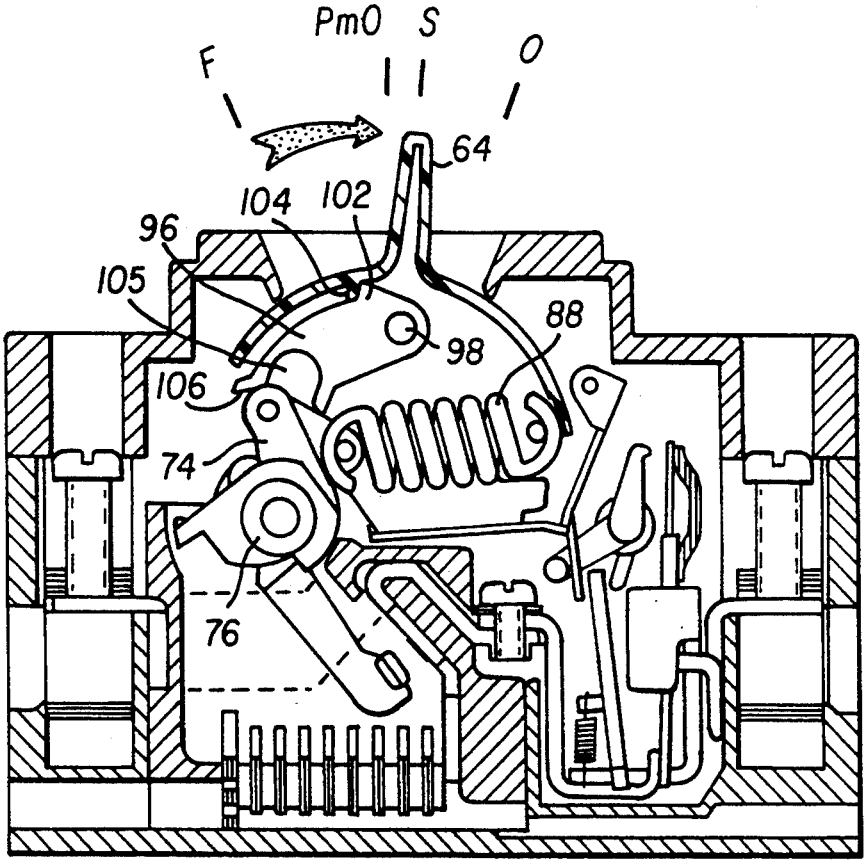

According to the invention, the mechanism 60 is in addition equipped with a locking lever 96 designed to prevent movement of the handle 64 to the open position O when the contacts 24, 34, 36 are either in a welded state (FIG. 4) or in a disconnection state (FIG. 5). The locking lever 96 is pivotally mounted on a horizontal spindle 98 of the support plates 78, 80, and comprises at its opposite end a fork 100 cooperating with the protuberance 74 of the switching bar 76. A stop 102 is arranged on the upper edge of the lever 96, between the fork 100 and spindle 98, said stop 102 being able to occupy an active position or an inactive position according to the angular position of the locking lever 96 which depends on that of the bar 76.

The internal surface of the base 92 of the handle 64 is provided with a blocking lug 104 designed to come into engagement against the stop 102 when the latter is in the active position.

Referring now to FIG. 1A, the fork 100 of the locking lever 96 presents a semi-open U-shaped notch 105, bounded on the left by a radiating bearing surface 106, and on the right by a tooth 108. The notch 105 is arranged to follow exactly the shape of the rounded end 110 of the protuberance 74 of the bar 76, so as to enable the end 110 to be inserted in the notch 105 when the bar 76 is close to the open position of the contacts. The bearing surface 106 is slightly curved in an arc of a circle centered on the spindle 112 of the bar 76. The radius R (FIG. 5A) of this bearing surface 106 is appreciably greater than the radius of the bottom of the notch 105.

Instead of being curved, the bearing surface 106 could also be flat, being appreciably tangent to the rounded end 110 of the protuberance 74, when the latter is disengaged from the notch 105.

The fixed pivoting spindle 98 of the locking lever 96 is situated on the support plates 78, 80 between the spring 88 and the internal surface of the base 92 of the handle 64.

Figure 1:
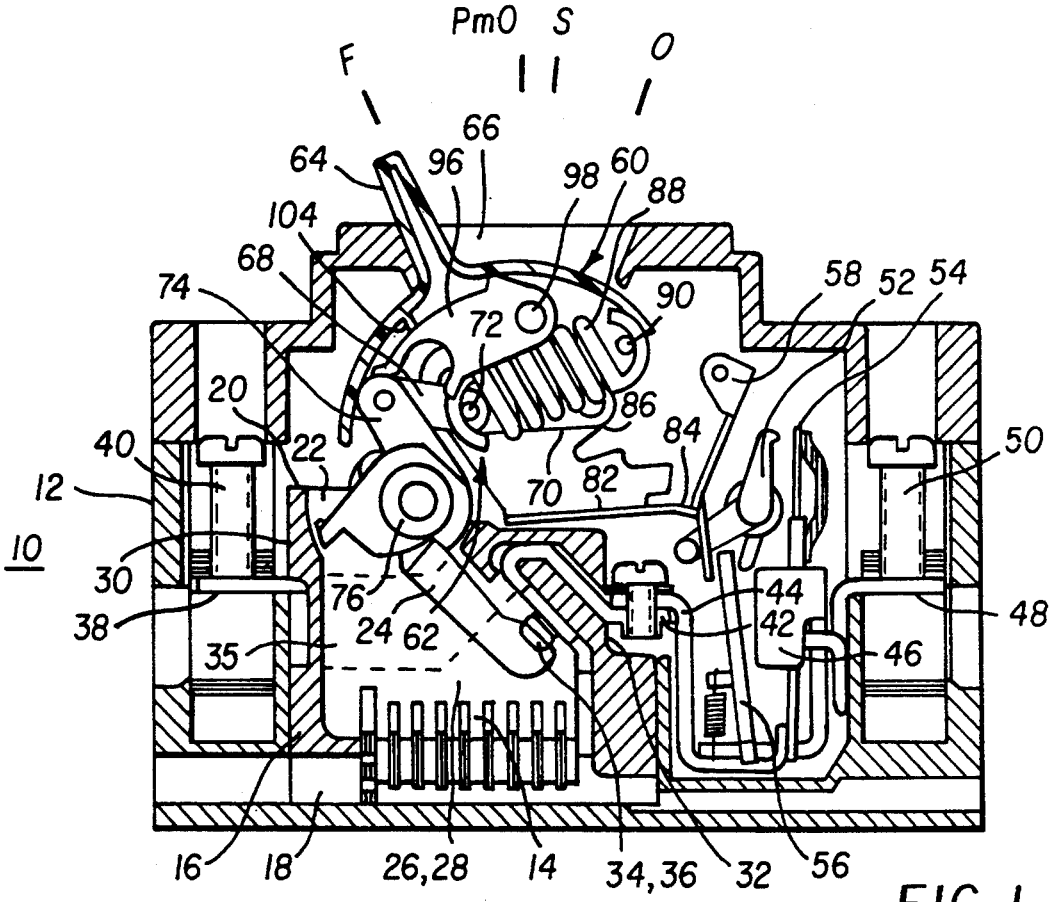
FIG. 1 is a schematic sectional view of a circuit breaker equipped with the mechanism according to the invention, the circuit breaker being represented in the closed position.

The mechanism 60 according to the invention operates as follows:

In the charged-closed state of the circuit breaker 10, represented in FIG. 1, the handle 64 is in the closed position F, and the contacts 34, 36, 24 are closed.

The bearing surface 106 rests on the end 110 of the protuberance 74 of the bar 76, the latter urging the locking lever 96 to the raised position, in such a way that the stop 12 is in the active position in engagement against the internal wall of the base 72 of the handle 64, but nevertheless separated from the lug 104 by a predetermined angular distance.

Manual opening of the contacts 34, 36, 24 of the circuit breaker 10 is brought about by pivoting of the handle 64 to the right. In spite of the raised position of the locking lever 96, imposed by the bar 76, the presence of the separation distance between the lug 104 and the stop 102 allows the pivoting movement of the handle 64 to the open position O. The nose of the stop 102 slides along the internal wall of the base 92 during this travel of the handle 64.

Figure 6A:
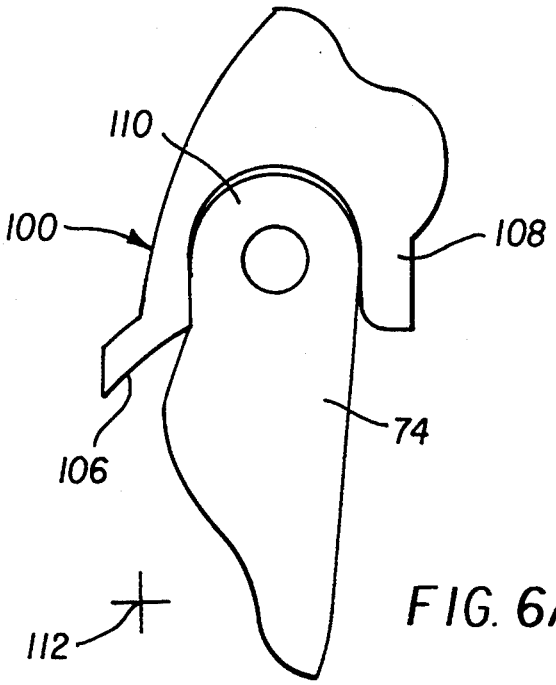
FIGS. 6 and 6A are identical views to FIGS. 1 and 1A, at the end of opening travel of the contacts after unblocking of the locking lever.
Figure 6:
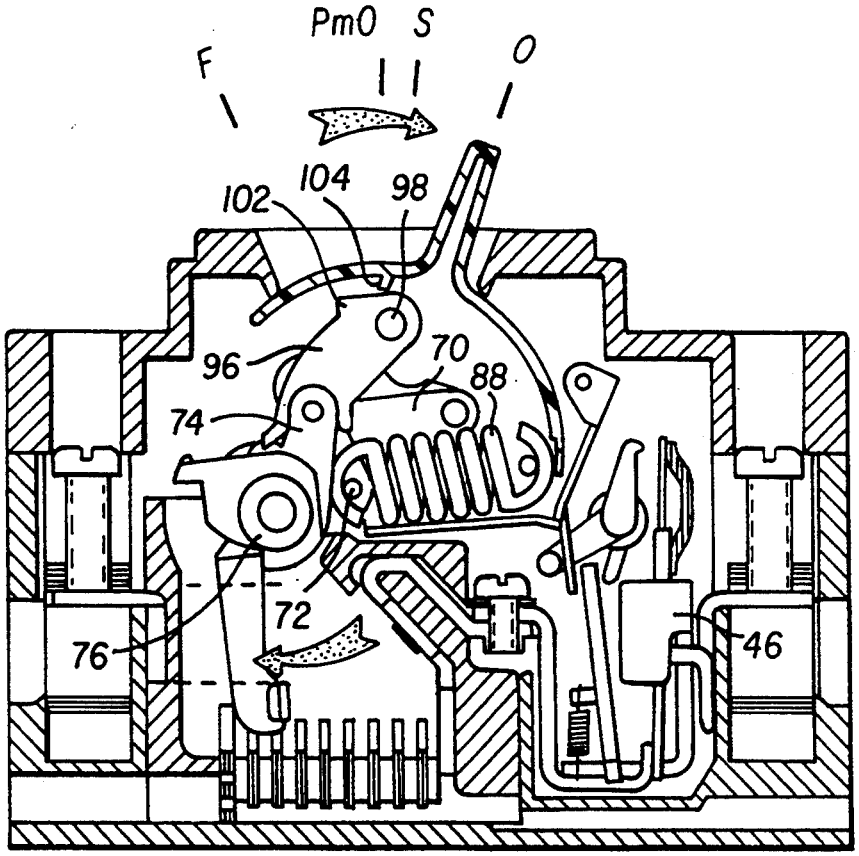

After the handle 64 has passed the opening deadpoint position PmO, the toggle 62 drives the switching bar 76 in clockwise rotation. This is a normal operation of the circuit breaker 10 in which the contacts separate until they reach the end of opening travel position (FIG. 6). Following this rotation of the bar 76, the end 110 of the protuberance 74 is no longer in contact with the bearing surface 106, but is engaged inside the notch 105 (FIG.

6A). The locking lever 96 pivots counterclockwise around its spindle 98 to a lowered unblocking position, which positions the stop 102 in an inactive position so as to escape from the lug 104. The handle 64 can be moved to the open position O, with the possibility of padlocking in this position.

It can be noted in FIGS. 5 and 5A that the locking lever 96 remains held in the raised blocking position at the beginning of the opening travel of the movable contact 24. The right-hand edge of the bearing surface 106 is still in engagement with the end 110, which enables blocking of the locking lever 96 to be maintained during a first part of the opening travel. The distance between the separated contacts corresponds to the isolation distance guaranteeing disconnection. The handle 64 is in an intermediate position S situated between the opening deadpoint position PmO and the open position O, and the lug 104 is stopped by the stop 102 so as to temporarily block the handle in the intermediate position S. Unblocking of the locking lever 96 takes place automatically when the movable contact 24 is almost open, which releases the latching between the lug 104 and the stop 102 enabling the handle 64 to be moved to the open position O.

Figure 4A:
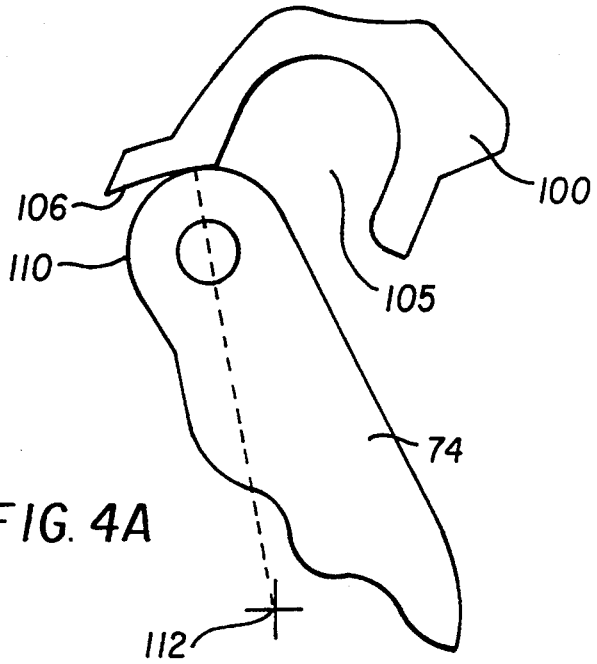
FIGS. 4 and 4A are identical views to FIGS. 1 and 1A, in the closed-welded position with blocking of the handle in the intermediate position.

FIGS. 4 and 4A represent the case of abnormal operation corresponding to a welded state of the contacts 34, 36, 24. The movable contact 24 is in the closed position, and the bar 76 remains immobile in the same position as that of FIG. 1. The bearing surface 106 cooperates with the end 110, which excludes any unblocking of the locking lever 96. The handle 64 is blocked positively in the intermediate position S by the latching action of the lug 104 against the stop 102, which prevents any attempt at forced movement of the handle 64 to the open position O preventing padlocking.

Engagement of the radiating bearing surface 106 on the end 110 of the bar 76 enables the locking lever 96 to be held in the fixed raised position until the handle 64 passes the intermediate position S after normal separation of the contacts. Temporary blocking of the stop 102 is maintained throughout the sliding movement of the end 110 along the radiating bearing surface 106 during rotation of the bar 76 around the spindle 112. Release of the stop 102 takes place at the end of opening travel, when the end 110 is inserted in the notch 105 making the locking lever 96 pivot to the lowered position.

We claim:

1. An operating mechanism of a multipole electrical circuit breaker, comprising:

a pair of parallel support plates between which the mechanism is housed, a toggle formed by a pair of first and second rods articulated together by means of a first pivoting spindle, a switching bar mechanically coupled to the first rod, and acting as support for the movable contacts of all the poles, said bar being mounted in rotation around a second parallel spindle, to ensure closing and opening of the contacts, a tripping hook pivotally mounted between a charged position and a tripped position around a third spindle of the support plates, and articulated simultaneously on the second rod, an operating handle securedly united to a base articulated on a fourth fixed spindle of the support plates, a latch cooperating with an end of the tripping hook to form a mechanical latching in the charged position, a connecting spring anchored between the first spindle and the base of the handle, and a locking lever cooperating with the bar to block the base in an intermediate position of the handle when the contacts are welded, said locking lever being pivotally mounted on a fifth spindle of the support plates, and comprising a stop able to occupy a first active position or a second inactive position according to the angular position of the bar, wherein the locking lever comprises a radiating bearing surface cooperating with a protuberance of the bar to keep holding the locking lever in the first active position of the stop, during a first part of the opening travel of the movable contact of each pole, and a notch for receiving said protuberance causing unblocking of the locking lever to release the base near the end of the opening travel of the movable contact.

2. The operating mechanism according to claim 1, wherein the bearing surface of the locking lever comprises a flat portion extending appreciably according to a direction tangent to the protuberance when rotation of the bar takes place during the first part of the opening travel.

3. The operating mechanism according to claim 1, wherein the protuberance slides along the radiating bearing surface in the course of rotation of the bar generating the first part of the opening travel, unblocking of the locking lever taking place after the handle has passed the intermediate position situated between an opening deadpoint and an open position.

4. The operating mechanism according to claim 1, wherein the locking lever is in the shape of a fork, in which said notch is bounded by the radiating bearing surface, and by a tooth.

5. The operating mechanism according to claim 1, wherein the bearing surface of the locking lever is formed by an arc of a circle centered on the second spindle of the bar, and the protuberance comprises an appreciably rounded end cooperating with said bearing surface.

6. The operating mechanism according to claim 5, wherein the stop is situated on the locking lever between the bearing surface and the fifth spindle, and the base is provided with a blocking lug designed to come into engagement in said intermediate position of the handle against the stop which is in the active position.

7. The operating mechanism according to claim 6, wherein the fifth pivoting spindle of the locking lever is situated between the connecting spring and the handle, extending parallel to the second spindle of the bar.

* * * * *